United States Patent [19]

Larson

[11] Patent Number: 4,919,108

[45] Date of Patent: Apr. 24, 1990

[54] CABLE GUARD ASSEMBLY FOR COMPOUND BOWS

[75] Inventor: Marlow W. Larson, Ogden, Utah

[73] Assignee: Browning, Morgan, Utah

[21] Appl. No.: 434,096

[22] Filed: Nov. 8, 1989

[51] Int. Cl.[5] ..... F41B 5/00

[52] U.S. Cl. ..... 124/88; 124/DIG. 1

[58] Field of Search ..... 124/23 R, 86, 88, 89, 124/90, DIG. 1

[56] References Cited

U.S. PATENT DOCUMENTS

| | | | |
|---|---|---|---|
| 4,452,222 | 6/1984 | Quartino et al. | 124/88 X |
| 4,542,732 | 9/1985 | Troncoso | 124/90 X |
| 4,596,228 | 6/1986 | Smith | 124/DIG. 1 X |

OTHER PUBLICATIONS

"The Roller Cable Guard Slide", Saunders Archery Company ad, *Bow and Arrow,* p. 19, Oct. 1985.

"6×6 TM Cable Guard Slide", Saunders Archery Company ad, *Bow and Arrow,* p. 19, Oct. 1986.

*Primary Examiner*—Randolph A. Reese

*Assistant Examiner*—Jeffrey L. Thompson

*Attorney, Agent, or Firm*—Trask, Britt & Rossa

[57] ABSTRACT

A cable-retaining fixture for a compound bow includes a body member with a pair of legs straddling a cable guard rod. A cable-retaining element extends from the body member opposite the legs, and a roller with a concave contact surface is mounted on an axle between the legs so that the concave surface rests against the rod.

7 Claims, 2 Drawing Sheets

CABLE GUARD ASSEMBLY FOR COMPOUND BOWS

BACKGROUND OF THE INVENTION

1. Field

This invention relates to compound archery bows. More specifically, it pertains to the cable guard assemblies of such bows and provides an improved cable-retaining fixture for the cable guard rod of such an assembly.

2. State of the Art

The rigging of compound archery bows includes a pair of eccentric members interconnected by cabling, including a central stretch, (with a bowstring segment), and a pair of end stretches. A design constraint of compound bows is the necessity for providing adequate arrow clearance for the fletching of an arrow launched by the string. Otherwise, the end stretches block the normal travel path of the arrow. Structures called cable guards or cable guard rods are typically attached to the handle riser of the bow to maintain this clearance.

Characteristically, the rigging and its components, especially the end stretches, cause noise during and following the launch of an arrow. Various expedients have been suggested whereby mechanisms attached to a cable guard rod couple with the end stretches to decrease this cable noise. These fixtures also assist in maintaining arrow clearance.

U.S. Pat. No. 4,452,222, the disclosure of which is incorporated by reference as a part of this disclosure, describes, at col. 1, lines 10 through 47, the problems encountered when a cable guard rod is positioned between the central stretch (string) and end stretches (cables) of the rigging of a compound bow to maintain arrow clearance. The patentees note the desirability of minimizing the lateral displacement of the cables from the string to minimize stress and wear on the cables, among other benefits. To avoid interference of the cable guard rod with the bowstring, the patentees suggested a cable-retaining member mounted rotatably and slidably on the rod with bore holes which slidably receive the cables. With this arrangement, the rod could be laterally displaced sufficiently from the string to avoid interference without the need for excessive lateral displacement of the cables. Although devices of this type serve their intended purpose well, the frictional resistance they impose upon the end stretches can cause erratic operation as well as intolerable wear on both the end stretch cables and the cable-retaining member.

U.S. Pat. No. 4,596,228, the disclosure of which is also incorporated by reference as a part of this disclosure, describes, at Col. 1, line 10 through Col. 2, line 22, the problems of cable noise generated by the end stretch cables resting upon a cable guard rod and various expedients relied upon to alleviate that noise. The patentee discloses an improved cable separator, (a form of cable-retaining member), which travels on the cable guard rod but which permits connection to the cables without the need for disassembly and reassembly of the bow. This device is also subject to the wear problems typical of prior art cable-retaining members.

Cable wear is reduced by a recent cable-retaining member for a cable guard assembly offered by Saunders Archery Company of Columbus, NE under the name "6×6 TM Cable Guard Slide." This device is relatively complex mechanically. It includes six separate rollers, two of which engage the cable guard rod and four of which contact the cable end stretches.

There remains a need for a cable-retaining member for a cable guard assembly of simple construction which nevertheless offers the advantages of noise reduction and optimum clearance without attendant undue cable wear.

SUMMARY OF THE INVENTION

The present invention provides a slidable fixture which is mounted to a cable guard rod for reciprocal movement in response to the shifting positions of the end stretches of the rigging of a compound bow. The fixture of this invention provides all of the benefits of the various cable guard assemblies of the prior art while avoiding the limitations of those assemblies. The contact surfaces of the fixture are minimal, thereby greatly reducing the wear induced by cable retention on the end stretches. A single, specially-configured roller provides for stable, low-friction travel of the fixture on the cable guard rod. The fixture can be mounted to the cable guard rod and the cables can be captured by the fixture, without the need for disassembly and reassembly of the bow.

The fixture includes a body member with a pair of legs which straddle the cable guard rod. The legs are linked by structure which carries a cable-retaining extension opposite the distal ends of the legs. A roller is mounted on an axle between the distal ends of the legs. This roller is specially configured with respect to the surface configuration of the cable guard rod. When the fixture is installed, the end stretches push the contact surfaces of the roller into engagement with the rod. A resilient surface may be provided at the contact surface interface between the rod and the roller.

The cable-retaining extension includes cable grooves which are accessible from the side. Accordingly, the end stretch cables can be placed within the grooves after the fixture is installed on the rod. The contact surface within the grooves is convex, thereby minimizing frictional contact between the cables and the fixture.

The single roller of the fixture of this invention is configured as a pair of truncated cones connected at their smaller ends so that the actual area of contact between the roller and the cable guard rod is near the central axis (and thus the axle) of the roller. The axle is longer than the width (diameter) of the cable guard rod, and is pulled towards the rod by forces transferred from the end stretch cables, through the distal ends of the legs straddling the rod, to opposite ends of the axle. The surface configuration of the roller effectively holds the legs and the connecting structure of the body member out of contact with the rod during operation of the bow. The opportunity for frictional wear is thus substantially eliminated.

A notable characteristic of this fixture is that it overcomes the disadvantages inherent in the sliding fixtures heretofore available without resorting to the complex mechanism previously thought to be required.

DESCRIPTION OF THE DRAWINGS

In the drawings, which illustrate what is presently regarded as the best mode for carrying out the invention.

DESCRIPTION OF THE ILLUSTRATED EMBODIMENT

Figure 1:
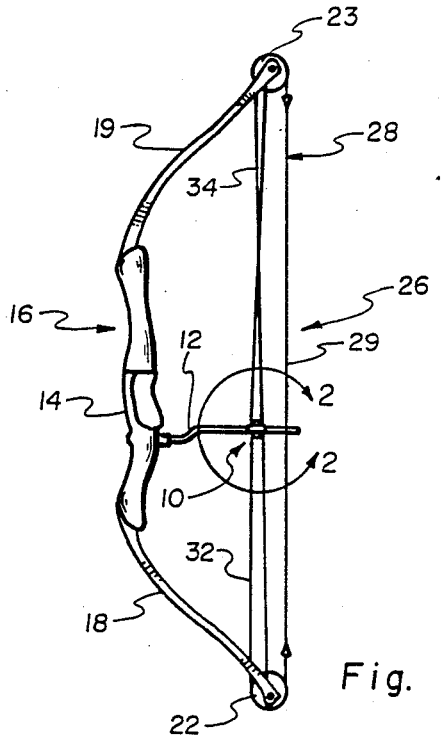
FIG. 1 is a side view of a compound archery bow with the invention mounted on a cable guard rod.

A sliding fixture of this invention, designated generally 10, is mounted to a cable guard rod 12. The rod 12 is cantilevered from the handle riser 14 of a compound archery bow, designated generally 16. The bow 16 includes a pair of limbs 18, 19 extending from the handle riser 14. Each limb 18, 19 carries an eccentric member 22, 23, respectively, at its distal end. The bow 16 includes rigging, designated generally 26. The rigging 26 includes the eccentrics 22, 23, and associated cables, including a central stretch 28, with a bowstring 29, and a pair of end stretches 32, 34. The cable guard rod 12 thus extends past and adjacent the end stretches 32, 34.

Figure 2:
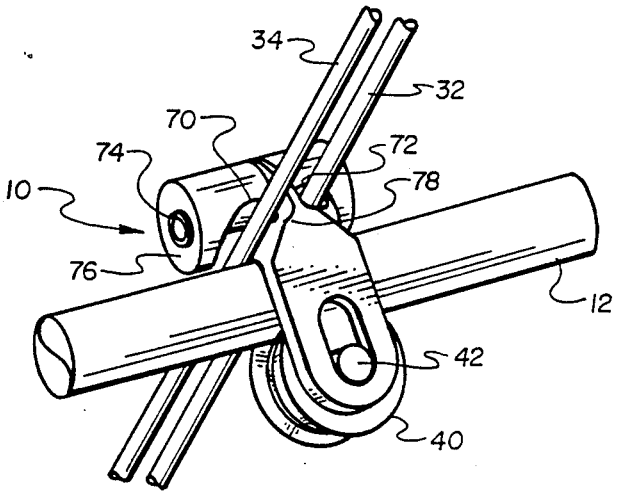
FIG. 2 is an enlarged view of the region 2—2 of FIG. 1 rotated approximately 180° and viewed in perspective.
Figure 3:
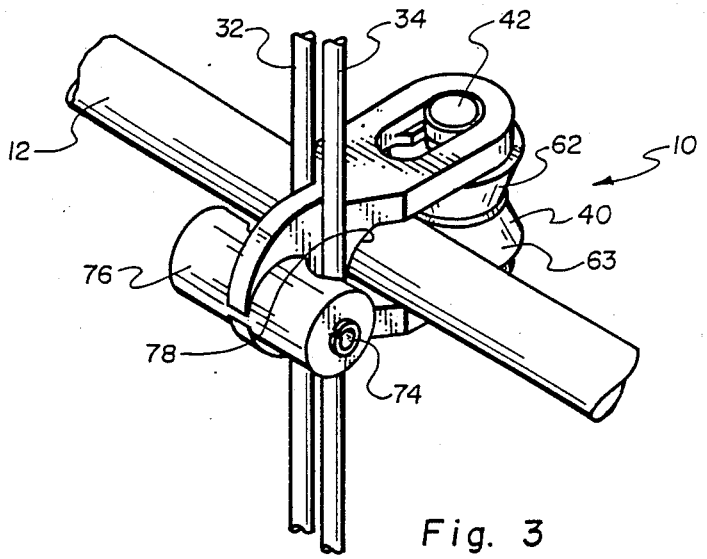
FIG. 3 is a view in perspective similar to FIG. 2 but from a different line of sight.
Figure 4:
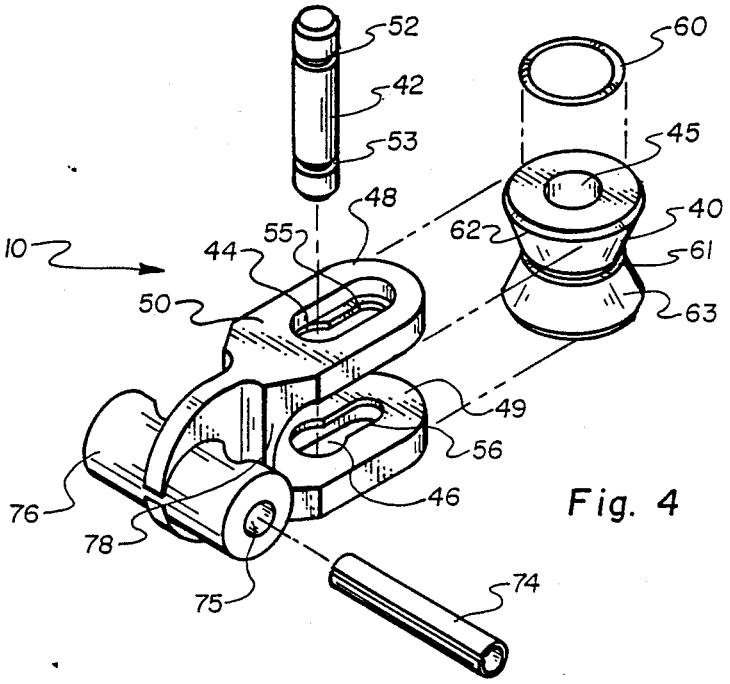
FIG. 4 is an exploded view of the invention illustrating its components in perspective.

As best shown by FIGS. 2 and 3, the cable end stretches 32, 34 are held adjacent the cable guard rod 12 by the fixture 10. Referring to FIG. 4, the fixture 10 is constructed of a few simple parts. A single roller 40 journals an axle 42. In assembly, the axle 42 is inserted through a first slot 44, the bore 45 in the roller 40 and a second slot 46, the slots 44, 46 being provided by the arms 48, 49 of the body member 50. the axle 42 includes grooves 52, 53 which register with ridges 55, 56. The ridges 55, 56 project inward within the slots 44, 46. As shown by FIGS. 2 and 3, with the roller 40 against the cable guard rod 12, the grooves 52 and 53 are restrained from dislodgement from the ridges 55, 56. A resilient "O"-ring 60 s retained by the groove 61 in the roller 40, providing a cushioned, low-wear contact surface with the rod 12. As shown, the groove 61 is at the approximate middle of the roller 40 transverse its central axis. The concave contact area provided by conical surfaces 62, 63, together with the width of the roller 40, provide excellent stability for the fixture 10 as it moves reciprocally along the rod 12.

The end stretches 32, 34 are restrained by grooves 70, 72. The sole surface contacting the cables is provided by a cylindrical roll pin 74 inserted through a bore 75 in cable-retaining extension 76. The pin 74 is thus located transverse and at least partially within the grooves 70, 72. A low-friction sliding connection is provided for the end stretches 32, 34 between the opposed convex round surfaces of the cable guard rod 12 and the roll pin 74. Because the end stretches tend to pull the connecting structure 78 away from the rod 12 and to draw roller 40 into firm engagement with the rod 12, the fixture 10 assumes a stable relationship with the rod 12. A reliable rolling contact is thus provided between the fixture 10 and the rod 12 by the single roller 40.

In operation, as the bowstring 29 is pulled to flex the limbs 18, 19, the distance between the handle riser 14 and the end stretches 32, 34 increases. The fixture 10 holds the end stretches 32, 34 adjacent the cable guard rod 12 to assure arrow clearance, and to dampen cable noise. The roller 40 permits low friction movement along the rod 12, thereby avoiding the operational difficulties experienced by many prior art devices. Under ordinary circumstances, lubrication of the roller 40 is unnecessary. A modest amount of axial movement of the end stretches 32, 34 between the rod 12 and roller pin 74 occurs during operation of the bow 16. This movement is accommodated without the need for lubrication and without significant wear on the end stretches 32, 34 while reducing the noise otherwise generated by the rigging 26 during operation of the bow 16. When the string 26 is released; e.g., to launch an arrow, movement of the fixture 10 with respect to the rod 12 and the end stretches 32, 34 with respect to the roll pin 74 are the reverse of their respective movements as the string 29 is drawn.

Reference herein to details of the illustrated embodiment is not intended to limit the scope of the appended claims.

What is claimed:

1. In a compound bow of the type which includes a handle riser, a pair of opposed limbs extending from the opposite ends of said handle riser, eccentric members pivotally mounted at the distal ends of said limbs, a rigging system including said eccentrics, a central stretch including a bowstring segment and a pair of end stretches, said end stretches each extending from a said eccentric across said handle riser to the limb opposite said eccentric, and a cable guard rod cantilevered from attachment to said handle riser past and adjacent said end stretches, a fixture reciprocally mounted to said stabilizer rod and slidably coupled to said end stretches so that as said bowstring is pulled from rest position to a drawn position, thereby flexing said limbs, said fixture is caused to move along said cable guard rod away from said handle riser by said end stretches while holding said end stretches away from the travel path of an arrow launched by said string; said fixture comprising:

a body member with a pair of legs straddling said cable guard rod, said legs each having proximal and distal ends;

structure connecting the proximal ends of said legs;

a roller rotatably mounted on an axle between the distal ends of said legs, said roller having a concave contact surface adjacent said cable guard rod; and a cable-retaining member extending from said body member opposite said distal ends of said legs, said member including a pair of cable-receiving grooves, each said groove being configured to engage a respective said end stretch against a convex contact surface.

2. A fixture according to claim 1 wherein said convex contact surface is provided by a cylindrical pin transverse to and within said grooves.

3. A fixture according to claim 1 wherein said roller has a central axis longer than the width of said cable guard rod.

4. A fixture according to claim 3 wherein said roller includes a resilient surface at its area of contact with said rod.

5. A fixture according to claim 3 wherein said concave surface is provided by said roller being formed as a pair of truncated cones connected at their small ends.

6. A fixture according to claim 5 including a resilient "O"-ring, positioned in a groove at the approximate middle of said roller transverse said central axis.

7. A fixture according to claim 6 wherein said convex contact, surface is provided by a cylindrical pin transverse to and within said grooves.

* * * * *